United States Patent [19]

Fischer et al.

[11] Patent Number: 4,467,180

[45] Date of Patent: Aug. 21, 1984

[54] ELECTRIC COOKING SYSTEM

[75] Inventors: Karl Fischer, Am Gänsberg 23, 7519 Oberderdingen; Felix Schreder, Oberderdingen, both of Fed. Rep. of Germany

[73] Assignee: Karl Fischer, Fed. Rep. of Germany

[21] Appl. No.: 422,670

[22] Filed: Sep. 24, 1982

[30] Foreign Application Priority Data

Oct. 8, 1981 [DE] Fed. Rep. of Germany ..... 3140074

[51] Int. Cl.[3] ..... H05B 3/68

[52] U.S. Cl. ..... 219/449; 219/445; 219/495; 219/512; 219/513; 337/386

[58] Field of Search ..... 219/445, 449, 450, 451, 219/452, 492, 494, 512, 513; 337/333, 383, 386

[56] References Cited

U.S. PATENT DOCUMENTS

| | | | |
|---|---|---|---|
| 4,135,081 | 1/1979 | Fischer | 219/449 |
| 4,214,151 | 7/1980 | Kichener et al. | 219/492 |

FOREIGN PATENT DOCUMENTS

| | | | |
|---|---|---|---|
| 1203883 | 10/1965 | Fed. Rep. of Germany | 219/449 |
| 1238593 | 4/1967 | Fed. Rep. of Germany | 219/449 |
| 2212157 | 9/1973 | Fed. Rep. of Germany | 219/449 |
| 2459649 | 7/1976 | Fed. Rep. of Germany | 219/449 |
| 679640 | 12/1964 | Italy | 219/449 |
| 404009 | 12/1965 | Switzerland | 219/449 |

*Primary Examiner*—Volodymr Y. Mayewsky
*Attorney, Agent, or Firm*—Steele, Gould & Fried

[57] ABSTRACT

A two-circuit automatic hotplate has a switch, which can be controlled both by a bimetallic strip of a power control device and by an expansion member of a hydraulic temperature sensor. The control heating system of the bimetallic strip is in series with a cooking heating system of the hotplate.

The electric power levels of the cooking heating systems are preferably selected in such a way that, wherever possible, a current of the same level flows through the control heating system for the bimetallic strip, so that the same bimetallic strip can always be used.

11 Claims, 3 Drawing Figures

ELECTRIC COOKING SYSTEM

BACKGROUND OF THE INVENTION

The invention relates to an electric cooker, particularly a hotplate or a glass ceramic cooking surface, with at least two cooking heating systems and a quantizing power control device. The control device has at least one switch operable by an expansion member, itself heatable by a control heating system for interrupting the power supply to at least one cooking heating system.

The object of the invention is to so further develop an electric cooker of the aforementioned type that the same expansion member can always be used under different conditions, for example with hotplates of different size and different total power. In addition, the characteristic of the power control device is to be such that the switching frequency is as low as possible in the case of a uniformly good control characteristic, so that the switch loading, and consequently the amount of silver required for contact silver coating, can be kept as low as possible.

BRIEF SUMMARY OF THE INVENTION

According to the invention, this object is achieved by an electric cooker, in which the control heating system is in series with at least one cooking heating system.

This makes it possible to so match the two cooking heating systems of the electric cooker to one another that the heat given off by the control heating system always corresponds to the same characteristic, so that it is always possible to use the same expansion member and the same reciprocal arrangement of expansion member, switches, etc.

It is particularly favourable if the controlled heating system connected with its other side to the cooking heating system is located on the cooker-side contact of the switch.

According to a further development of the invention, the power control device has two switches, the series connection between control heating system and the cooking heating system being located at the output of the first switch. The use of the two switches makes it possible to provide a further possibility for controlling the electric cooker.

With this arrangement, according to the invention, it is possible for the second cooking heating system to be at the output of the second switch. The two switches then preferably open at different temperatures, the second switch preferably opening at a lower temperature than the first switch. This means that below a first temperature of the expansion member, e.g. two cooking heating systems of the hotplate can be operated in parallel, while on exceeding a first temperature, only one cooking heating system remains in operation. In general, this second cooking heating system is adequate to maintain the hotplate temperature, so that the second switch need not be put into operation again. This naturally reduces the switching frequency of this switch.

The features of the invention can be used with particular advantage in conjunction with an automatic hotplate having a hydraulic temperature sensor, whose expansion member also acts on the switch or on both switches. Thus, the power supplied to the hotplate by the hydraulic regulator is again timed by the power control device, which can reduce the switching frequency and simultaneously lead to maintaining a temperature more precisely.

According to the invention, it can be advantageous for a cooking heating system to be located at the output of both switches, both outputs being bridged by the control heating system. This means that if both switches are closed, the control heating system receives no voltage and consequently does not heat. Only when one of the two switches is opened by the expansion member of the hydraulic sensor, is voltage supplied to the control heating system, so that it heats. It can therefore lead to heating and expansion of the expansion member of the power control device.

Thus, both switches have the advantage of a common input contact. It is particularly favourable if, according to another feature of the invention, the switch is a double snap-action switch.

The power and/or resistance of the cooking heating system can be advantageously selected in such a way that the same current always flows through the current-traversed control heating system.

The following table gives examples for a total of six different hotplates with two different sizes, the right-hand column giving the current through the control heating system of the power control device. It can be seen that this current is always 3.95 A.

TABLE

| Diameter | Total power | Voltage | 1st heating system power | 2nd heating system power | Current through heating system |
|---|---|---|---|---|---|
| 145 mm | 1500 | 220 | 630 | 870 | 3.95 |
| | 1500 | 240 | 550 | 950 | 3.95 |
| | 1500 | 380 | — | 1500 | 3.95 |
| 180 mm | 2000 | 220 | 1130 | 870 | 3.95 |
| | 2000 | 240 | 1050 | 950 | 3.95 |
| | 2000 | 380 | 500 | 1500 | 3.95 |

BRIEF DESCRIPTION OF THE DRAWINGS

The invention is described in greater detail hereinafter relative to non-limitative embodiments and with reference to the attached drawings, wherein.

DETAILED DESCRIPTION OF THE PREFERRED EMBODIMENTS

Figure 1:
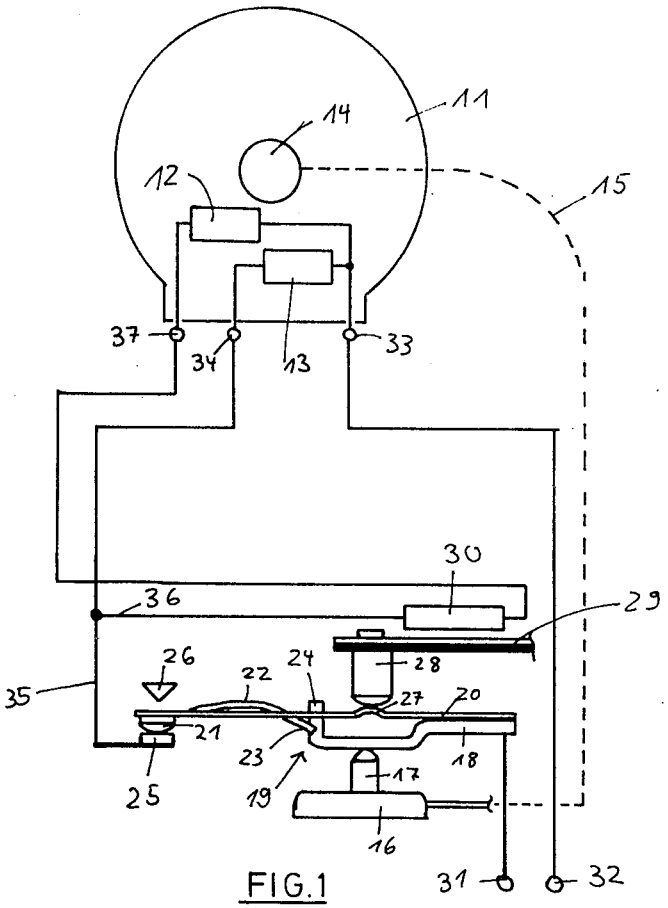
FIG. 1 is an arrangement with a two-circuit automatic hotplate.

FIG. 1 diagrammatically shows a hotplate 11, which has two individually switchable cooking heating systems 12, 13. In the center of hotplate 11, there is an hydraulic temperature sensor 14 connected to the expansion member 16 by line 15 (indicated by dotted lines). On the top of expansion member 16, there is an attachment 17, which acts on a U-shaped member 18 of a snap-action switch 19. At the right-hand end of U-shaped member 18 is fixed a resilient tongue 20, which at its left-hand end carries the movable contact 21 of switch 19. Spring 22 of tongue 20 is supported by its free end 23 in a notch in the vertically directed leg 24 of U-shaped member 18. The movable contact 21 of tongue 20 rests on the fixed contact 25 of the switch. A diagrammatically represented stop member 26 is positioned above the left-hand end of tongue 20. An attachment 28 of a bimetallic strip 29 acts on the central part of tongue 20 provided at the top with a bent-out portion 27. The right-hand end of strip 29 is fixed, although this is not shown in the drawing. Above bimetallic strip 29 is shown control heating system 30, which is closely thermally coupled to the strip 29. U-shaped member 18 is connected via a line to an input terminal 31, while the second input terminal 32 leads directly to the connection 33 of hotplate 11.

The fixed, hotplate-side contact 25 is connected to the second connection 34 of hotplate 11, cooking heating system 13 being positioned between connections 33 and 34. The line 35 from fixed contact 25 to connection 34 has a branch 36, which forms a connection between contact 25 and the third connection 37 of hotplate 11 via control heating system 30. Thus, control heating system 30 is in series with one cooking heating system 12.

The apparatus functions in the following manner. The mains voltage is applied to terminals 31 and 32. When hotplate 11 is cold, snap-action switch 19 is closed, i.e. contacts 21 and 25 engage with one another, so that current flows through the cooking heating system 13 and through the series connection of cooking heating system 12 and control heating system 30. As the result, control heating system 30 is heated and this leads to a downward bonding of bimetallic strip 29 in FIG. 1. On reaching a predetermined bend quantity of strip 29, snap-action switch 19 snaps over, so that the back of tongue 20 engages on stop member 26. Therefore, the circuit through the hotplate and control heating system 30 is interrupted and after a certain time the snap-action switch closes again.

As result of temperature sensor 14, there is a temperature-dependent displacement or bending of U-shaped member 18, so that the actual temperature of hotplate 11 influences the functioning of switch 19. The measures proposed by the invention could still be advantageously used if such a temperature regulator was not provided.

Figure 2:
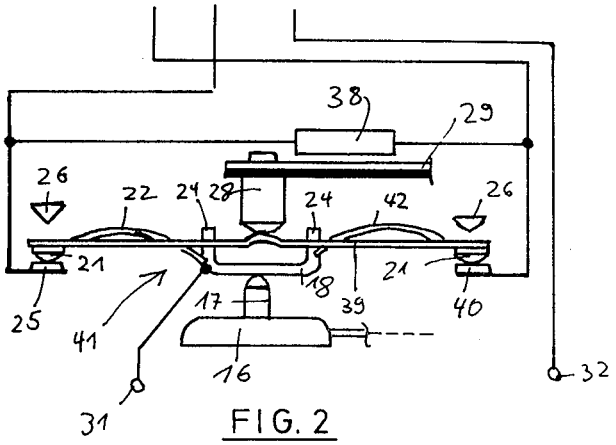
FIG. 2 is an arrangement corresponding to FIG. 1 of a modified control device.

FIG. 2 shows a similar arrangement, in which once again a control heating system 38 acts on a bimetallic strip 29. Once again, U-shaped member 18 is connected to an input terminal 31, but on this occasion each end of tongue 39 has a movable contact 21. Therefore, the double snap-action switch 41 has two fixed contacts 25 and 40, contact 40 being connected to connection 37 of hotplate 11 of FIG. 1 and contact 25 to connection 34 of hotplate 11 in FIG. 1. The first connection 33 of hotplate 11 is again connected to terminal 32.

The double snap-action switch 41 has two springs 22, 42, the right-hand spring 42 in FIG. 2 being placed at its free end somewhat further upwards in vertical leg 24 of U-shaped member 18 than the left-hand spring 22 in the left-hand vertical leg 24 of member 18. This means that on reaching a lower temperature, the right-hand part of double-action snap switch 41 opens, while the left-hand part thereof leading to connection 34 only opens at a second and higher temperature.

The function of the arrangement shown in FIG. 2 is such that below a first temperature, control heating system 38 is on both sides at the voltage prevailing at terminal 31, so that no current flows through it. However, on reaching a predetermined temperature, which leads to a displacement of the U-shaped member 18 due to attachment 17 of expansion member 16, the right-hand movable contact 21 is raised, so that now the right-hand connection of control heating system 38 is at a different voltage to the left-hand connection thereof. Thus, control heating system 38 is heated, bimetallic strip 29 is deformed and the left-hand switch opens at a second temperature.

Figure 3:
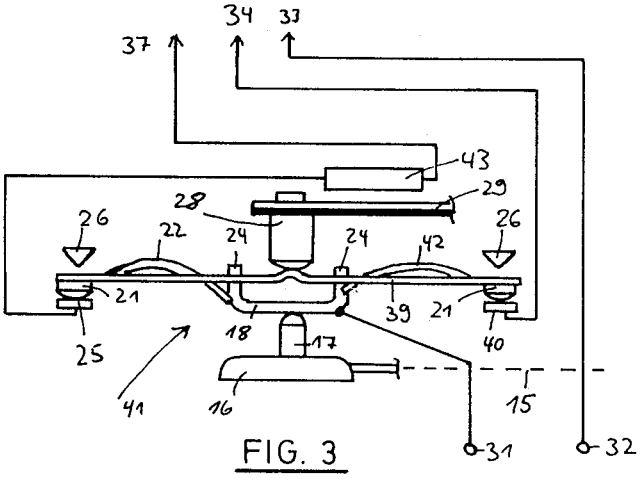
FIG. 3 is a further modified embodiment.

FIG. 3 shows an arrangement similar to that of FIG. 2. The difference compared with the embodiment of FIG. 2 is that the fixed contact 25 of the left-hand half of snap-action switch 41 is connected to the control heating system 43, whose other end leads to connection 37 of hotplate 11. The right-hand fixed contact 40 of double snap-action switch 41 leads directly to the second connection 34 of hotplate 11, while the first connection 33 of hotplate 11 is connected to input terminal 32.

The operation of the arrangement of FIG. 3 is such that when the hotplate is cold, current passes through the parallel connection of the two cooking heating systems 12 and 13. Following heating of the hotplate and/or control heating system 43 at a first temperature, current only flows through cooking heating system 12, while on a further increase thereof, the left-hand part of double snap-action switch 41 opens and consequently interrupts the current flow through cooking heating system 12.

The invention provides the possibility in all three cases of using the same bimetallic strip 29 and in the cases of FIGS. 2 and 3 the same double snap-action switch and the same expansion member 16.

The same bimetallic strip 29 can also be used in the case of an only power-controlled hotplate, i.e. a hotplate without temperature sensor 14, line 15 and expansion member 16. Tongue 20 or 39, U-shaped member 13 and springs 22, 42 are made entirely of metal, so that current can flow from input terminal 31 to contacts 21.

What is claimed is:

1. An electric cooking system for hot plates, glass ceramic topped hot plates and the like, comprising:

at least two electrical heating circuits for cooking;

a quantizing electrical power control device, having at least one switch operable by a thermally responsive expansion member, for interrupting power supply to at least two of the cooking heating circuits at the same time; and, an electrical heater for controlling the expansion member of the at least one switch, the electrical heater being connected in series with at least one of the cooking heating circuits.

2. An electric cooking system according to claim 1, wherein the electrical heater for controlling the expansion member is connected in series between the at least one switch and the at least one of the cooking heating circuits.

3. An electric cooking system according to claim 2, further comprising a cooking-temperature sensor for controlling the switching temperature of the at least one switch.

4. An electric cooking system according to claim 2, wherein the ratio of rated power of the at least two cooking heating circuits is chosen to provide a constant value of current flow through the electrical heater for controlling the expansion member whenever the at least one switch is closed.

5. An electric cooking system according to claim 1, wherein the power control device comprises first and second switches, the series connection of the electrical heater for controlling the expansion member and the at least one of the cooking heating circuits being interposed at the output of the first switch.

6. An electric cooking circuit according to claim 5, wherein the second cooking heating system is connected to the output of the second switch.

7. An electric cooking system according to claim 6, wherein the second switch opens at a different temperature than the opening temperature of the first switch.

8. An electric cooking system according to claim 7, wherein the second switch opens at a lower temperature than the first switch.

9. An electric cooking system according to claim 5, wherein a cooking heating circuit is connected to each output of both switches and both outputs are operationally bridged by the electrical heater for controlling the expansion member.

10. An electric cooking system according to claim 5, wherein both switches have a common input contact.

11. An electric cooking system according to claim 5, wherein the first switch is a double snap-action switch.

* * * * *